United States Patent [19]

Goldstein et al.

[11] Patent Number: 4,809,513

[45] Date of Patent: Mar. 7, 1989

[54] ICE MELTING IN THERMAL STORAGE SYSTEMS

[75] Inventors: Vladimir L. Goldstein, Woodbridge; Ram N. Sukhwal, Mississauga, both of Canada

[73] Assignee: Sunwell Engineering Company Limited, Woodbridge, Canada

[21] Appl. No.: 897,876

[22] Filed: Aug. 19, 1986

[51] Int. Cl.[4] ..... F25D 3/00

[52] U.S. Cl. ..... 62/59; 62/434

[58] Field of Search ..... 62/434, 185, 96, 123, 62/59, 430, 529

[56] References Cited

U.S. PATENT DOCUMENTS 3,828,570 8/1974 Stutz ..... 62/282

4,480,445 11/1984 Goldstein ..... 62/434

4,509,344 4/1985 Ludwigsen et al. ..... 62/434

*Primary Examiner*—Henry A. Bennet

*Attorney, Agent, or Firm*—Spencer & Frank

[57] ABSTRACT

The invention provides in one of its aspects a thermal storage heat exchanger. The heat exchanger receives through a first input a slurry of fine ice particles in an aqueous solution having a concentration below its eutectic concentration, the ice particles and solution being stored in said heat exchanger as a porous ice bed and a substantially ice-free liquid bath. The heat exchanger also receives heated aqueous solution through a second input and discharges liquid phase refrigerant through the first output. Distribution means are locatable above said ice bed within the heat exchanger to distribute the heated solution evenly through the porous ice bed.

39 Claims, 7 Drawing Sheets

ICE MELTING IN THERMAL STORAGE SYSTEMS

This invention relates to thermal storage systems and more particularly to ice thermal storage systems for air-conditioning.

In thermal storage systems, ice is made during the off-peak hours when cooling is not required and is stored in the storage tank.

According to the present invention there is provided a thermal storage heat exchanger, said heat exchanger receiving through input means, a slurry of fine ice particles in an aqueous solution having a concentration below its eutectic concentration, the ice particles and solution separating to be stored in said heat exchanger as a porous ice bed and a substantially ice-free liquid bath, said heat exchanger also receiving through said input means a heated aqueous solution, and discharging said heated aqueous solution through output means, said output means including distribution means located above ice bed and within said heat exchanger and constituting means for distributing said heated aqueous solution evenly onto the upper surface of said porous ice bed to melt said ice bed uniformly and enhance heat transfer between said heated aqueous solution and said porous ice bed. In this particular storage tank, the ice is separated from the liquid phase refrigerant in the thermal storage heat exchanger so as to form a porous ice bed and a bath of secondary refrigerant within the thermal storage heat exchanger. A dense porous ice bed is thereby accumulated during the cooling stage and the heated refrigerant can be passed through this ice bed to recover the stored energy during the peak cooling demand condition.

To generate a partially frozen refrigerant solution in which fine ice particles are retained in suspension, an ice making machine of the type described in U.S. Pat. No. 4,551,159 (Goldstein), issued Nov. 5, 1985, the complete specification of which is incorporated herein by reference, can be used with the system described above.

In practice, with the system described above, the heated brine is not passed evenly through the pores in the ice bed, and tends to flow through channels formed in the centre of the ice bed, or at the sides. For an efficiently operating thermal storage system, it is critical that the heated solution be passed through the ice bed evenly, for maximum melting of the ice.

It is an object of the present invention to obviate or mitigate the above-mentioned disadvantages.

Accordingly, the invention provides in one of its aspects a thermal storage heat exchanger, the heat exchanger receiving through a first input a slurry of fine ice particles in an aqueous solution having a concentration below its eutectic concentration, the ice particles and solution being stored in said heat exchanger as a porous ice bed and a substantially ice-free liquid bath, the heat exchanger also receiving heated aqueous solution through a second input and discharging liquid phase refrigerant through an output, said input means including distribution means located above the ice bed and within the heat exchanger and constituting means for distributing the heated solution evenly through the porous ice bed to melt said ice bed uniformly and enhance heat transfer between said heated solution and said porous ice bed.

Preferably, the distribution means is connected to the second input.

Preferably, the distribution means comprises a plurality of nozzles located on a nozzle header. The nozzle header is preferably rotatable about a vertical axis. Optionally a motor is used to rotate the nozzle header. The nozzles may be inclined to the vertical axis.

Preferably, the output is located below the ice bed and said second input is located above the ice bed. The distribution means may preferably include bypass means which withdraw liquid solution at the ice bed and discharge liquid solution below the ice bed.

Preferably, the distribution means includes a rotatable cutter to cut a predetermined thickness of the ice bed at every rotation, the cutter being rotatable by a motor.

In another of its aspects, the invention provides a heat pump having a heat source, a heat sink and a thermal storage heat exchanger in which heat energy is cyclically accumulated and discharged by circulation of a secondary refrigerant therethrough, wherein:

(i) the secondary refrigerant is an aqueous solution having a concentration which is below its eutectic concentration;

(ii) the heat sink is adapted to supercool the aqueous solution to generate supercooled secondary refrigerant, which is partially frozen and contains fine ice particles in suspension;

(iii) the thermal storage heat exchanger has a storage chamber;

(iv) input means communicating between said storage chamber and heat sink for admitting said supercooled secondary refrigerant is provided, such that when supercooled secondary refrigerant is admitted, the ice particles will separate from the liquid phase refrigerant to form a porous ice bed and a substantially ice-free liquid bath said output means also communicating between said storage chamber in the heat source for admitting heated refrigerant from the heat source to said storage chamber;

(v) an output means communicating with said storage chamber is provided for discharging liquid phase refrigerant from said storage chamber for circulation to said heat sink;

(vi) said input means including a distribution means locatable above said ice bed and within said thermal storage heat exchanger distributing said heated refrigerant evenly onto the upper surface of said porous ice bed, to melt said ice bed uniformly and enhance transfer between said heated solution and said porous ice bed.

The invention further provides, in another one of its aspects, a method of distributing heated aqueous solution having a concentration below its eutectic concentration evenly through a porous ice bed in a bath of cool aqueous solution to enhance heat transfer therebetween, the method comprising the steps of spraying the upper surface of said porous ice bed uniformly with the heated solution at a plurality of locations.

The invention further provides in another one of its aspects a method of distributing heated aqueous solution having a concentration below its eutectic concentration evenly through a porous ice bed in a bath of aqueous solution in a thermal storage heat exchanger, the method comprising the step of floating the ice above the water level of the bath.

The invention further provides in another one of its aspects a method of distributing heated aqueous solution having a concentration below its eutectic concentration evenly through a porous ice bed in a bath of aqueous solution in a thermal storage heat exchanger, the method comprising the steps of withdrawing cooled solution at the base of said heat exchanger and admitting heated solution at the top of said heat exchanger above said ice bed at a plurality of locations and spraying uniformly the surface of said ice bed with said heated solution to enhance heat transfer therebetween and subsequently withdrawing cooled solution at the top of said heat exchanger above said ice bed, and admitting heated solution at the base of said heat exchanger.

The distribution means provided by the present invention allow the heated liquid to be distributed relatively evenly through the porous ice bed to increase the heat transfer between the heated solution and the ice bed, and thereby increase the efficiency of the thermal storage heat exchanger.

With the nozzles spaced above the ice bed the heated liquid is passed over the entire surface of the bed so that increased ice water contact occurs. A rotatable header with nozzles is preferably used to cause the brine to hit the ice surface and dig into the ice bed. This action causes some of the ice to be cut and be mixed with the brine to form a slurry. This cutting and mixing action provides a greater contact area between the ice and the warm brine.

Floats are preferably used to support the ice bed above the liquid bath to provide sufficient head to counter the flow resistance of the bed. The cutter causes the ice particles to be further separated from one another to provide a larger contact area between the ice and the brine. The preferable use of the bypass means allows the solution to stay in contact with the ice for longer periods of time.

The invention will now be described, by way of example only, with reference to the following drawings, in which:

FIG. 1A is a schematic illustration of a heat pump system;

FIB. 1B is a schematic illustration of an alternative embodiment of a heat pump system;

Figure 1A:
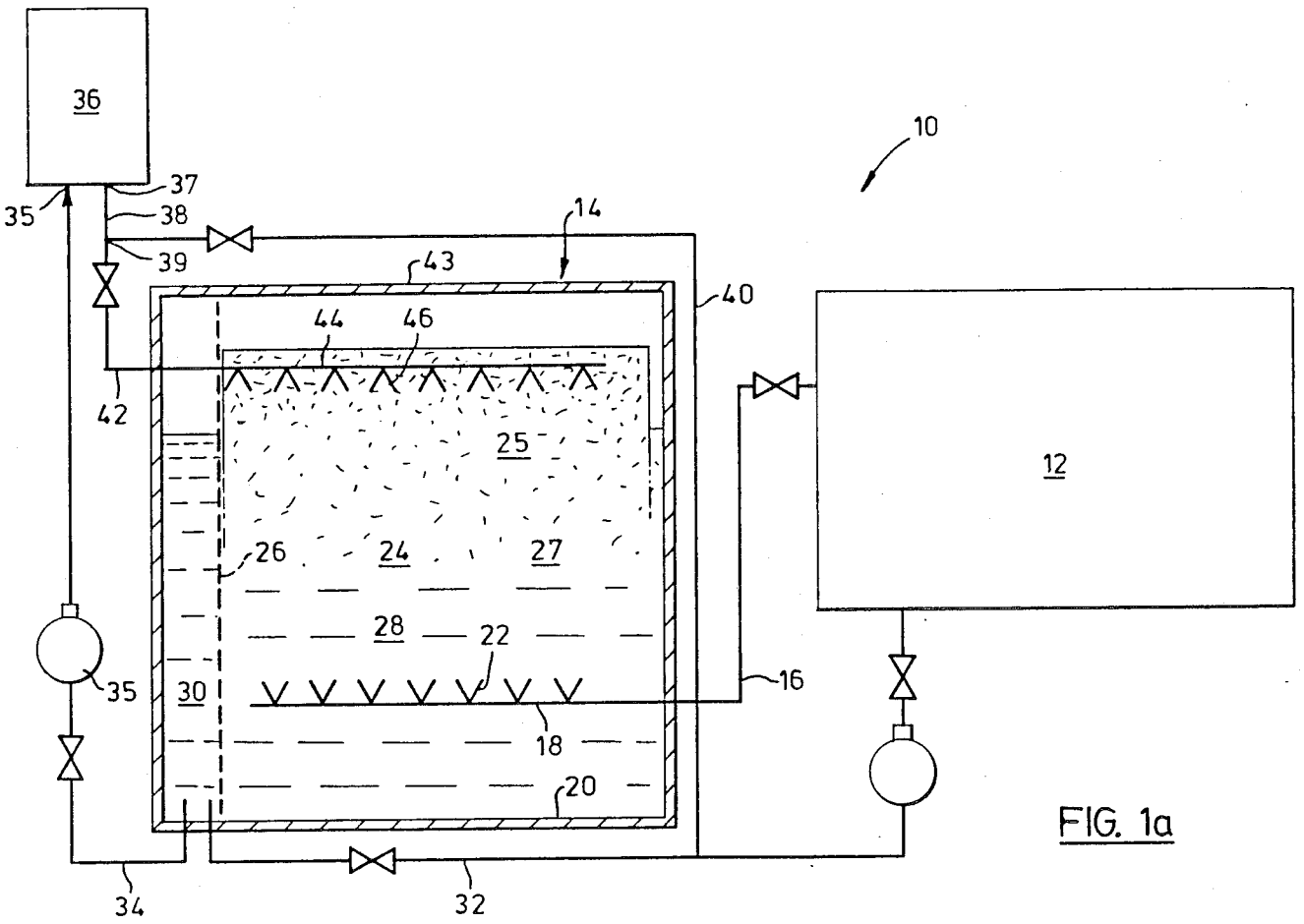

Referring to FIG. 1, it can be seen that a thermal storage system 10 similar to that shown in U.S. patent application No. 656,246 includes an ice generator 12 connected to a thermal storage heat exchanger 14 through an inlet pipe 16. This pipe 16 has a cool liquid distribution portion 18 which extends into the heat exchanger 14 near the base 20 thereof having spaced distribution nozzles 22 along the length thereof.

The thermal storage heat exchanger comprises a storage tank defining a storage chamber 24. A barrier wall 26 serves to divide the chamber into a first compartment 28 and a second compartment 30. The barrier 26 is porous to permit liquid to pass through but prevent ice from passing through.

A first outlet pipe 32 at the base 20 of the heat exchanger in the second compartment 28 passes from the second chamber back to the ice generator 12. A second outlet pipe 34 passes from the second compartment adjacent the first outlet pipe 32 through a pump 35 to the inlet 35 of a heat source 36. The heat source outlet 37 is connected by a pipe 38 through a T-junction 39 to a recycle pipe 40 leading to the first outlet pipe 32 and a second inlet pipe 42 leading to the top of the thermal storage heat exchanger. This second inlet pipe 42 has a heated liquid distributor portion 44 extending into the thermal storage heat exchanger 14 near the top 43 of the heat exchanger. This portion 44 has nozzles 46 along the length thereof.

The operation of the thermal heat exchanger is as follows. Supercooled refrigerant consisting of fine particles of ice suspended in an aqueous solution of a concentration lower than its eutectic concentration is generated in the ice generator 12 and is fed into the thermal storage heat exchanger through pipe 16. The supercooled refrigerant separates into an ice bed 25 and a bath of solution 27. Some of the liquid exits from the thermal heat exchanger through pipes 32 and 34. The liquid in outlet pipe 34 is pumped into the heat source 36 which heats the liquid. The liquid then passes through pipe 38 to either recycle pipe 40 which connects with pipe 32 and is pumped into the ice generator 12, or to second inlet pipe 42 which distributes the heated liquid in the ice bed 25 through nozzles 46 on portion 44.

The ice generator 12 is preferably similar to that shown in U.S. Pat. No. 4,551,159, (Goldstein) although any ice maker that will make fine ice particles suspended in an aqueous solution of a concentration less than its eutectic concentration can be used. The heat source 36 is a heat load device which may be a heat exchanger in the form of a cooling coil, solar collector, chiller or the like.

Figure 1B:
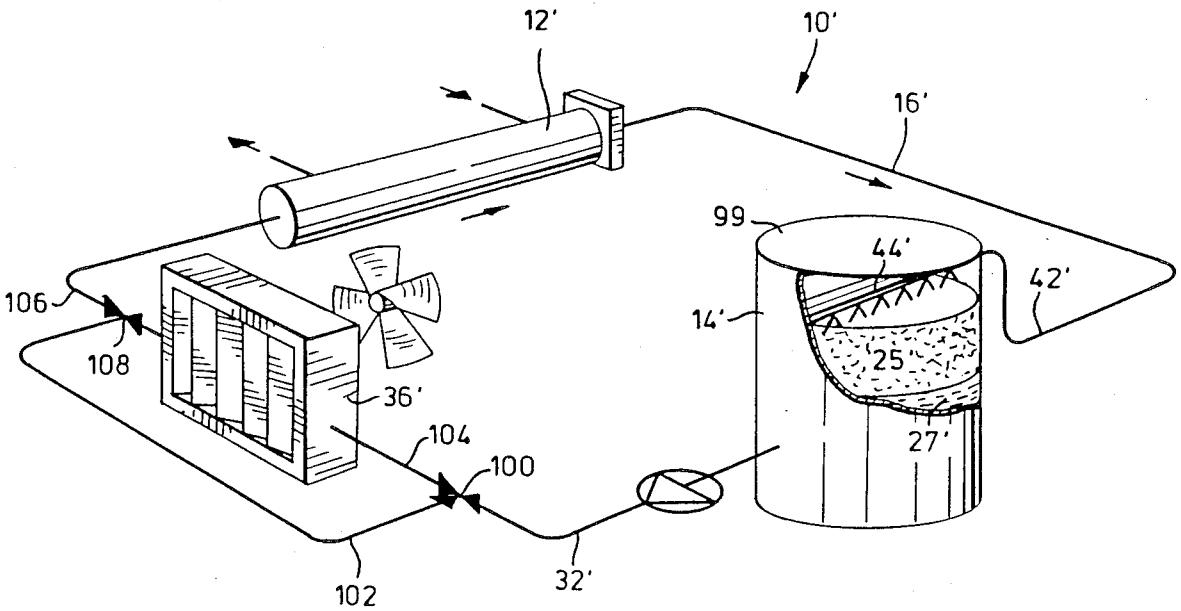

An alternative storage system 10' is shown in FIG. 1B. Elements which are similar to those of FIG. 1A are given the same number as in FIG. 1A, followed by the symbol '. The ice generator 12' of this system 10' is connected to the top portion 99 of a thermal storage heat exchanger 14' through heat exchanger inlet pipes 16'. This pipe has a liquid distribution portion 44' which extends into the heat exchanger 14' near the top 99 thereof. The thermal storage heat exchanger 14' is essentially the same as that shown in FIG. 1A.

A first thermal heat exchange outlet pipe 32' leads from the thermal storage heat exchanger and terminates in a three-way valve 100. This valve 100 is connected to a bypass pipe 102 and a heat source inlet pipe 104. The heat source inlet pipe 104 leads to a heat source 36' which is shown as being a fan coil.

A heat source outlet pipe 106 leads from the heat source 36'. A check valve 108 is located in this pipe to allow flow in only one direction. The bypass pipe 102 is connected to the heat source outlet pipe 106 after the check valve. The heat source outlet pipe 106 is connected to the ice generator 12'.

This system 10' operates as follows. During off-peak hours, i.e. during the night, supercooled refrigerant consisting of fine particles of ice suspended in an aqueous solution of a concentration lower than its eutectic concentration is generated in the ice generator 12' and is fed into the thermal storage heat exchanger through pipe 16'. The supercooled refrigerant separates into an ice bed 12' and a bath of solution 27'. Some of the liquid exits from the thermal heat exchanger 14' through thermal heat exchanger outlet pipe 32'. The three-way valve is moved to a bypass position wherein the connection to pipe 104 is closed and the connection to pipe 102 is open. The liquid in pipe 32' therefore passes through the bypass pipe 102 and through heat source inlet pipe 106 to the ice generator. The check valve 108 prevents flow of liquid in the pipe 102 to the heat source 36'. In the off-peak hours, ice is thus accumulated in the heat exchanger 14'.

During peak hours, i.e. during the day, the ice generator is shut off. The three-way valve is moved to a heat source position, wherein the connection to pipe 102 is closed and the connection to pipe 104 is opened. Liquid from the heat exchanger 14' is passed through pipe 32' to pipe 104 and is then passed through the heat source 36' wherein it is heated. The heated liquid is returned to the heat exchanger 14' through pipe 106, the ice generator, and pipe 16'.

In the heat exchanger 14', the liquid passes through a bed of ice 25' and is cooled.

Alternatively, during peak hours, the ice generator could be turned on and operated at a temperature sufficient to precool, but not freeze the liquid. Thus, part of the cooling load is removed before the liquid is passed to the heat exchanger 14'. As the load is split between the heat exchanger 14' and the ice generator 12', both can be smaller.

Figure 2:
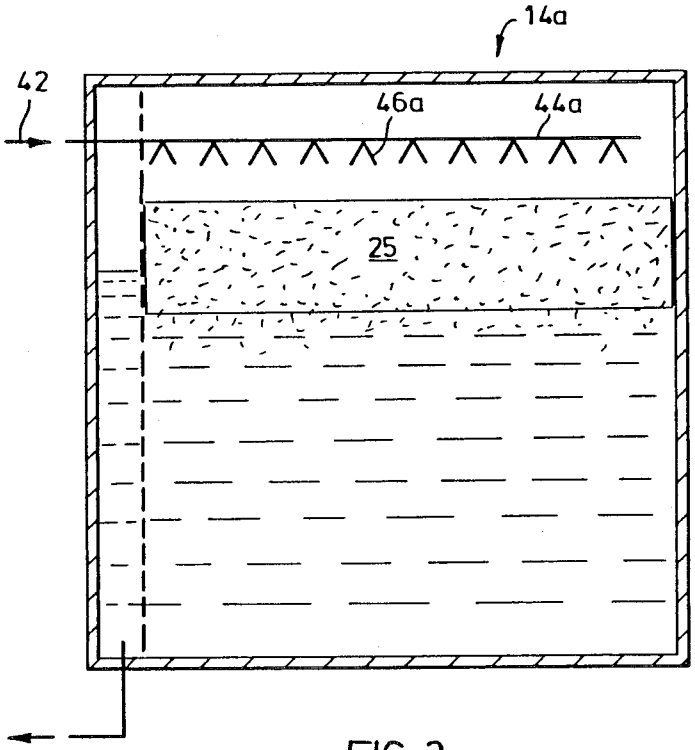
FIG. 2 is a schematic illustration of a thermal heat exchanger with a heated water distribution element therein.

FIG. 2 shows a thermal heat exchanger 14 such as that used in either FIG. 1A or FIG. 1B, wherein the liquid distribution portion **44*a* leading into the thermal heat exchanger, is positioned above the ice bed 25 whereas the conventional designed liquid distribution portion 44 shown in FIGS. 1A and 1B is shown positioned in the bed. The spaced nozzles 46*a* therefore spray directly onto the surface of the ice bed 25**. With this configuration, the warm brine can be distributed over the entire surface of the ice bed so that maximum possible ice/water contact occurs and so that bypassing of the surface of the ice by the brine is avoided.

Figure 3B:
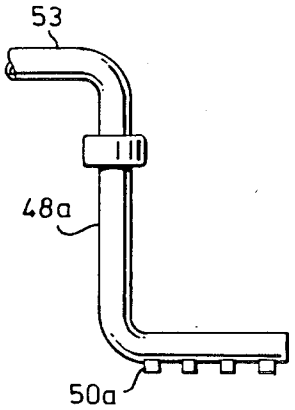
FIGS. 3A and 3B show distribution elements having rotatable headers with nozzles mounted thereon.
Figure 4B:
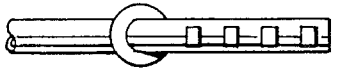
FIGS. 4A and 4B show views from underneath of the distribution elements of FIGS. 3A and 3B, respectively.
Figure 3A:
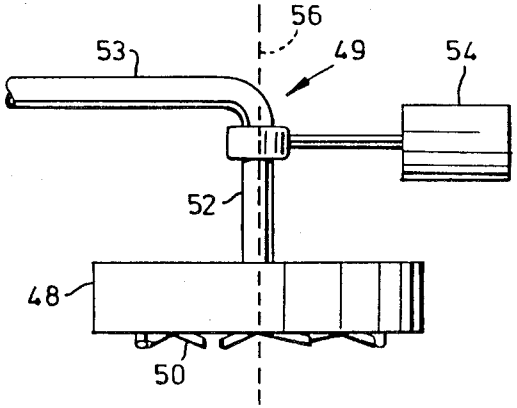
Figure 4A:
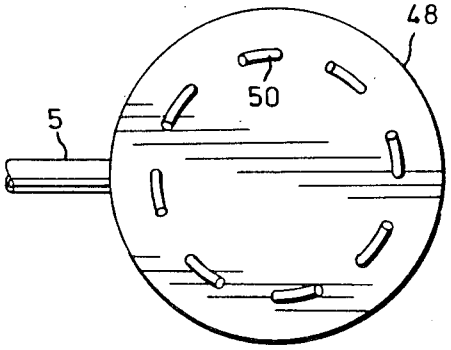

FIGS. 3A and 4A show an alternative way of distributing the heated solution over the surface of the ice bed. The portion 44 is replaced with a distribution element 49. FIG. 3A shows a header 48, having nozzles 50 attached thereto. The nozzles 50 are inclined slightly to the vertical in a clockwise direction. This header 48 is connected to a pipe 52 which is pivotally connected to a pipe 53 leading from the centre 56 of the heat exchanger to the second inlet pipe 42. A motor 54 is attached to the pipe 52 to drive the header 48. In operation, the motor 54 causes the header 48 to rotate in the clockwise direction, and heated solution is fed through the inlet 42 and passes out through the nozzles 50.

The nozzles can optionally be directed in the direction opposite to the direction of header rotation, which would obviate the need for a motor, as the spray from the nozzles would drive the header. When the motor is used, the nozzles can be pointed downward or in the direction of header rotation.

Tests performed on ice melting with the self-driven configuration indicates that good and even ice melting results when the nozzles are tilted at about 15° to 20° from the normal downward direction in a direction opposite to the header rotation. The nozzles are selected such that a uniform rate of six sprays per unit area GPM/ft$^2$ is achieved. Test show that ice melting is more efficient by using the motor-driven rotating headers compared to the self-driven rotating headers. Also, better melting was achieved when the nozzles were tilted in the direction of the rotating header as compared to when the nozzles were pointed downward. However, more power is needed to turn the header when the nozzles are tilted in the direction of rotation of the header.

The use of the rotating headers causes the brine to hit the ice surface and dig into the ice bed cutting some ice and mixing it with the brine to form a slurry. This cutting and mixing action provides a greater contact area between the ice and the warm brine.

FIGS. 3B and 4B show an alternative configuration of the embodiment shown in FIGS. 3A and 4A. In this configuration, the header **48*a*** is L-shaped, with the nozzles attached to the lower part of the "L".

Figure 5:
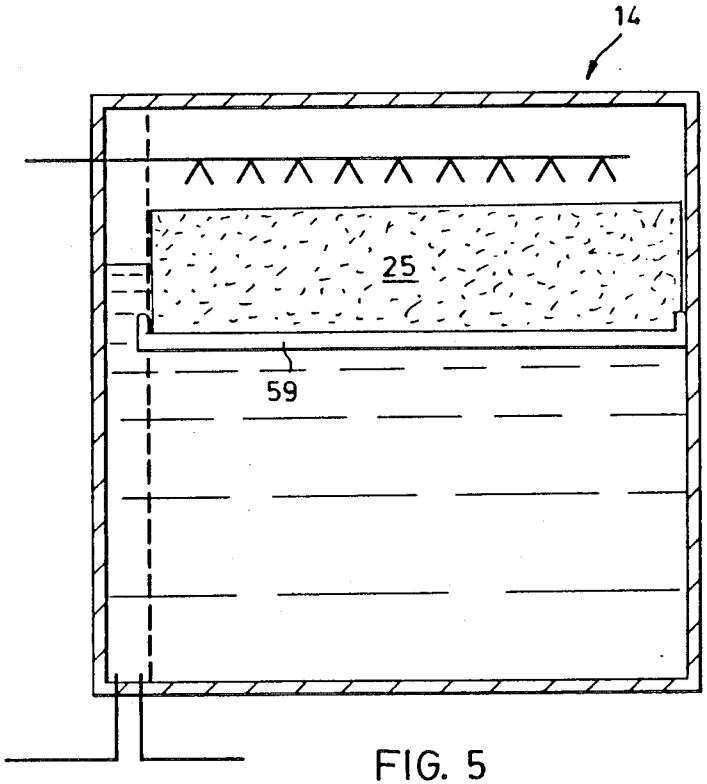
FIG. 5 shows a thermal heat exchanger with an alternative form of distribution element.

FIG. 5 shows another embodiment of the thermal heat exchanger, wherein a float 59 is inserted underneath the ice bed 25 to support the ice bed 25 above the water level of the bath. This level difference provides sufficient head to counter the flow resistance of the ice bed 25. In normal melting operation, some level difference is available during the start of melting, but reduces as the melting progresses. With the float 59, the ice bed will be above the water level at all times. The float can be made of any material having a density less than that of brine, and can be of any configuration suitable to keep the ice afloat, such as a plate or a plurality of interconnected cylindrical floats. These floats can be used with the standard heated liquid distributor portion 44 shown in FIG. 1, or with the distribution elements shown in FIGS. 2, 3A, 3B, 4A and 4B previously described.

Figure 6:
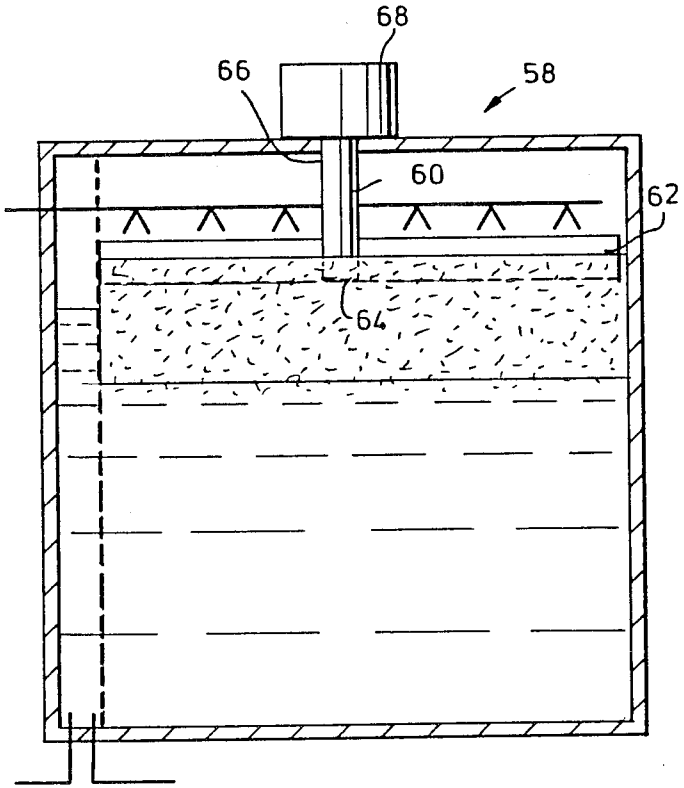
FIG. 6 shows a thermal heat exchanger having a scraper therein.

FIG. 6 shows an additional alternative distribution element. A cutter device 58 comprising a shaft 60 with cutter blades 62 mounted on the periphery thereof at one end 64 and driven at the other end 66 by a motor 68, is mounted in the top portion of the thermal heat exchanger, such that its lower end 64 extends down a predetermined distance into the ice bed 25. This cutter device 58 can be rotated by the motor 68 to cut a predetermined thickness of the ice 25. As brine is sprayed over the freshly cut ice, high melting rates can be achieved as during the cutting action the ice particles are well separated from each other and consequently a larger contact area is provided between the ice particles and the warm brine. This cutting device can be used in conjunction with the brine distribution elements shown in FIGS. 2, 3, 3B, 4 and 4B.

Figure 7:
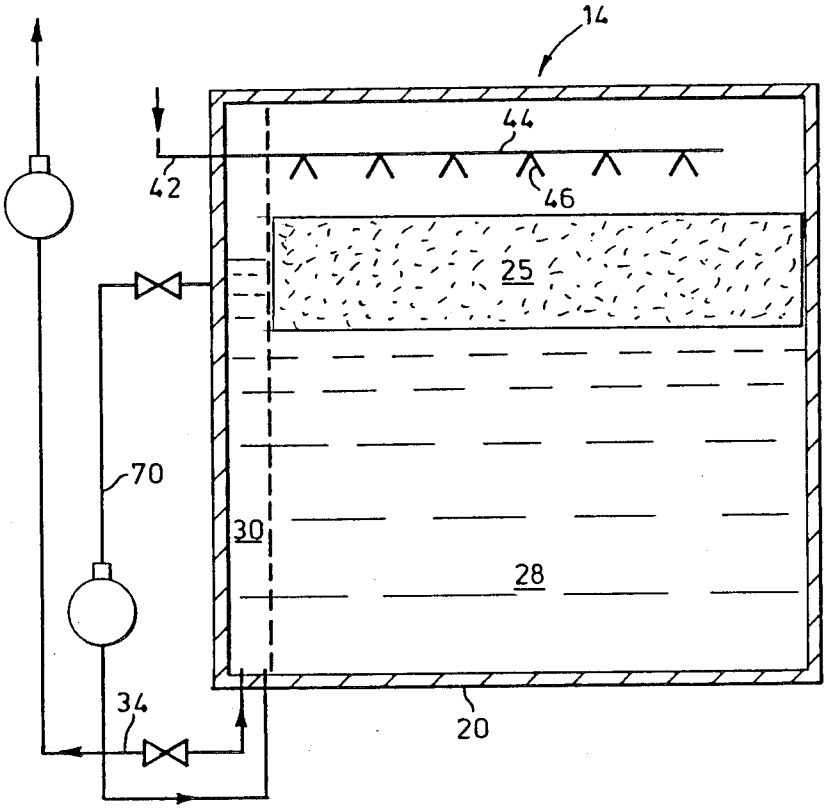
FIG. 7 shows a thermal heat exchanger having a second alternative distribution element.

FIG. 7 shows an alternative embodiment wherein brine is alternatively introduced in the top of the tank through distribution element 44, and discharged from the bottom of the tank through second outlet pipe 34 or is introduced in the bottom of the tank through pipe 70 and discharged at the level of the ice bed 25. The configuration is identical to that shown in FIG. 2 except for the addition of the pipe 70 connected at one end at the level of the ice bed 25, and connected at the other end to the second compartment 30 of the thermal heat exchanger at the base 20 of the heat exchanger 14. The flow of heated brine through the thermal heat exchanger is continuously switched from introduction in the base to introduction near the top of the heat exchanger. This continuously switching over process allows the solution to stay in contact with the ice for a longer period of time which may result in more efficient melting. The alternate change-over between the top and the bottom may be continuously performed by using timers and solenoid valves.

We claim:

1. A thermal storage heat exchanger, said heat exchanger receiving through input means, a slurry of fine ice particles in an aqueous solution having a concentration below its eutectic concentration, the ice particles and solution separating to be stored in said heat exchanger as a porous ice bed and a substantially ice-free liquid bath, said heat exchanger also receiving through said input means a heated aqueous solution, and discharging said heated aqueous solution through output means, said output means including distribution means located above said ice bed and within said heat exchanger and constituting means for distributing said heated aqueous solution evenly onto the upper surface of said porous ice bed to melt said ice bed uniformly and enhance heat transfer between said heated aqueous solution and said porous ice bed.

2. A heat exchanger as claimed in claim 1 wherein said distribution means comprises a plurality of nozzles located on a nozzle header.

3. A heat exchanger as claimed in claim 2 wherein said nozzle header is rotatable.

4. A heat exchanger as claimed in claim 3 wherein a motor is used to rotate the nozzle header.

5. A heat exchanger as claimed in claim 3 wherein said nozzles are inclined to a vertical axis, and rotated thereabout.

6. A heat exchanger as claimed in claim 4 wherein said nozzles are inclined to a vertical axis, and rotated therabout.

7. A heat exchanger as claimed in claim 5 wherein said nozzles are inclined in a direction opposite to the direction of rotation of the nozzle header, to provide for self-rotation of said nozzles and header when said solution passes through said nozzles.

8. A heat exchanger as claimed in claim 6 wherein said nozzles are inclined in the direction of rotation of said nozzle header.

9. A heat exchanger as claimed in claim 1 wherein said output means is located below said ice bed and said input means is located above said ice bed.

10. A heat exchanger as claimed in claim 1 wherein said output means is located below said ice bed and wherein said input means comprise a first input through which said slurry is received and a second input through which said heated aqueous solution is received, said first input being located above said ice bed and said second input being located above said ice bed.

11. A heat exchanger as claimed in claim 9 or 10 wherein said distribution means includes bypass means which withdraw liquid solution at said ice bed and discharge liquid solution below said ice bed.

12. A heat exchanger as claimed in claim 2, 3 or 4 wherein said distribution means includes a rotatable cutter to cut a predetermined thickness of said ice bed at every rotation, said cutter being rotatable by a motor.

13. A heat exchanger as claimed in claim 1 wherein said distribution means includes a flotation means mounted on the base of said ice bed to cause said ice bed to float above the water level of the bath.

14. In a heat pump having a heat source, heat sink and a thermal storage heat exchanger in which heat energy is cyclically accumulated and discharged by circulation of a secondary refrigerant therethrough, the improvements comprising:

(i) said secondary refrigerant is an aqueous solution having a concentration which is below its eutectic concentration;

(ii) said heat sink is adapted to supercool the aqueous solution to generate supercooled secondary refrigerant, which is partially frozen and contains fine ice particles in suspsension;

(iii) said thermal storage heat exchanger has a storage chamber;

(iv) providing input means communicating between said storage chamber and heat sink for admitting said supercooled secondaray refrigerant, such that when supercooled secondary refrigerant is admitted, the ice particles will separate from the liquid phase refrigerant to form a porous ice bed and a substantially ice-free liquid bath, said input means also communicating between said storage chamber and the heat source for admitting heated refrigerant from the heat source to said storage chamber;

(v) providing an output means communicating with said storage chamber for discharging liquid phase refrigerant from said storage chamber for recirculating to said heat source; and (vi) said input means including a distribution means located above said ice bed and within said thermal storage heat exchanger and constituting means for distributing said heated refrigerant evenly onto the upper surface of said porous ice bed to melt said ice bed uniformly and to enhance heat transfer between said heated solution and said porous ice bed.

15. A heat pump as claimed in claim 14 wherein said distribution means comprises a plurality of nozzles located on a nozzle header.

16. A heat pump as claimed in claim 15 wherein said nozzle header is rotatable.

17. A heat pump as claimed in claim 16 wherein the motor is used to rotate the nozzle header.

18. A heat pump as claimed in claim 16 wherein said nozzles are inclined to a vertical axis, and rotated thereabout.

19. A heat pump as claimed in claim 17 wherein said nozzles are inclined to a vertical axis, and rotated thereabout.

20. A heat pump as claimed in claim 18 wherein said nozzles are inclined in a direction opposite to the direction of rotation of the nozzle header, to provide for self-rotation of said nozzles and header when said solution passes through said nozzles.

21. A heat pump as claimed in claim 19 wherein said nozzles are inclined in the direction of rotation of said nozzle header.

22. A heat pump as claimed in claim 14 wherein said output means is located below said ice bed and said input means is located above said ice bed.

23. A heat pump as claimed in claim 14 wherein said output means is located below said ice bed and wherein said input means comprises a first input through which said slurry is received and a second input through which said heated aqueous solution is received, said first input being located below said ice bed and said second input being located above said ice bed.

24. A heat pump as claimed in claim 22 or 23 wherein said distribution means includes bypass means which withdraw liquid solution at said ice bed and discharge liquid solution below said ice bed.

25. A heat pump as claimed in claim 15, 16 or 17 wherein said distribution means includes a rotatable cutter to cut a predetermined thickness of said ice bed at every rotation, said cutter being rotatable by a motor.

26. A heat pump as claimed in claim 14 wherein said distribution means includes flotation means mounted on the base of said ice bed to cause said ice bed to float above the water level of the bath.

27. A method of distributing heated aqueous solution having a concentration below its eutectic concentration evenly through a porous ice bed in a bath of cool aqueous solution to enhance heat transfer therebetween, the method comprising the steps of spraying the upper surface of said porous ice bed uniformly with the heated solution at a plurality of locations.

28. The method of claim 27 further comprising the step of moving the locations of spraying so that the entire surface is evenly sprayed and some cutting of at least the surface of the ice bed is provided.

29. The method of claims 27 or 28 further comprising the step of cutting a predetermined thickness of the upper surface of said ice.

30. A method of distributing heated aqueous solution having a concentration below its eutectic concentration evenly through a porous ice bed in a bath of aqueous solution in a thermal storage heat exchanger, the method comprising the step of floating the ice above the water level of the bath.

31. A method of distributing heated aqueous solution having a concentration below its eutectic concentration evenly through a porous ice bed in a liquid bath of aqueous solution in a thermal storage heat exchanger, the method comprising the steps of withdrawing a cooled solution at the base of said heat exchanger and admitting heated solution at the top of said heat exchanger above said ice bed at a pluraltiy of locations and spraying uniformly the upper surface of said ice bed with said heated solution to enhance heat transfer therebetween and subsequently withdrawing solution at the top of said heat exchanger above said ice bed, and admitting solution at the base of said heat exchanger.

32. A method as claimed in claim 31 wherein said steps are repeated at predetermined intervals.

33. A method of effecting thermal storage comprising the steps of:

during low peak periods, generating a slurry of fine ice particles in an aqueous solution having a concentration below its eutectic concentration, passing said slurry to a heat exchange zone wherein the ice particles and the solution separate to be stored in the heat exchanger as a porous ice bed and a substantially ice-free liquid bath, and recycling solution to said ice generation zone; and during peak periods, passing solution through a heat sink zone wherein said solution is heated, and recycling said heated solution through the porous ice bed in said heat exchange zone while simultaneously distributing said heated solution evenly through said porous ice bed by spraying said heated solution from above said ice bed.

34. The method of claim 33 wherein said heated solution is cooled after being passed through said heat sink zone and prior to being recycled to said porous ice bed.

35. The method of claim 33 wherein said heated solution is distributed through said ice bed by spraying said solution onto the surface of said ice bed at a plurality of locations.

36. The method of claim 35 wherein the location of spraying is moved so that the entire surface is evenly sprayed and some cutting of at least the surface of the ice bed is provided.

37. The method of claim 35 or 36 further comprising the step of cutting a predetermined thickness of the upper surface of said ice while distributing said heated solution through said porous ice bed.

38. The method of claim 33 wherein said heated solution is distributed by withdrawing cooled solution at the base of said heat exchanger and admitting heated solution at the top of said heat exchanger above said ice bed at a plurality of locations and subsequently withdrawing solution at the top of said heat exchanger above said bed and admitting solution at the base of said heat exchanger.

39. The method of claim 38 wherein said liquid is distributed at predetermined intervals.

* * * * *